US005921300A

United States Patent [19]

Smith

[11] Patent Number: 5,921,300

[45] Date of Patent: Jul. 13, 1999

[54] LOG-SPLITTING DEVICE

[76] Inventor: Kelvin M. Smith, 2419 Old Thompson Bridge Rd., Apt. A-2, Gainesville, Ga. 30501

[21] Appl. No.: 09/006,971

[22] Filed: Jan. 14, 1998

[51] Int. Cl.[6] ..... B27L 7/00

[52] U.S. Cl. ..... 144/195.7; 144/193.1; 144/366; 173/94

[58] Field of Search ..... 144/193.1, 193.2, 144/195.3, 195.6, 195.7, 366; 173/90, 94, 96, 98, 110

[56] References Cited

U.S. PATENT DOCUMENTS

| | | | |
|---|---|---|---|
| 899,328 | 9/1908 | Saecker | 144/193.1 |
| 946,705 | 1/1910 | Power | 144/193.1 |
| 1,231,525 | 6/1917 | Hauberg | 144/193.1 |
| 4,491,164 | 1/1985 | Waikas et al. | 144/366 R |
| 4,625,782 | 12/1986 | Jameson | 144/193.1 |
| 4,751,949 | 6/1988 | Berner | 144/195.7 |
| 4,802,518 | 2/1989 | Knight | 144/193.1 |
| 5,002,134 | 3/1991 | Yamada | 173/98 |
| 5,488,997 | 2/1996 | Yamada | 173/94 |

*Primary Examiner*—W. Donald Bray
*Attorney, Agent, or Firm*—Law Office of Victor E. Libert; Frederick A. Spaeth

[57] ABSTRACT

A power log splitter includes a base (28) and a wedge (12) and a ram (34) mounted on the base for receiving a log (31) lengthwise between them. A motor (16) turns a cam means (26) to deliver a series of short, quick blows onto one of the wedge (12) and ram (34), to generate strokes by which the wedge (12) splits the log (31). Preferably, there are more than two strokes per second; each stroke preferably has a duration of not more than about 0.05 second and the length of each stroke is preferably not more than 5 percent of the log length capacity $L_m$, typically not more than 0.75 inch. The device includes a worm shaft (36) and transmission box (38) to urge together wedge (12) and ram (34) in a motion that is independent of the strokes produced by the rotating cam means (26).

18 Claims, 7 Drawing Sheets

LOG-SPLITTING DEVICE

BACKGROUND OF THE INVENTION

1. Field of the Invention

This invention relates to log-splitting devices and, in particular, to self-powered log-splitting devices.

Self-powered log-splitting devices, commonly referred to as "power log splitters", typically comprise a blade or wedge that is pressed into a log or a screw that is screwed into the log. Devices that make use of a wedge and a stop member (often referred to as a "ram") can be classified by the power means used to drive the blade into the log. Thus, e.g., there are hydraulic splitters, which employ a hydraulic pump to impel a wedge into a log, and rack-and-pinion splitters in which the wedge is mounted on a rack driven by a pinion, the pinion being rotated by a motor. In an article by A. J. Hand entitled "PS Buyer's Guide to Power Log Splitters", published in *Popular Science* magazine, August 1979, page 101, the author states that hydraulic splitters take about 20 seconds to split logs, and that the fastest splitter known was the FXG Super Split rack-and-pinion splitter, which is said to have a cycle time of around 2 seconds. The article also acknowledges that a power log splitter may have a motor-driven worm shaft to drive the wedge into the log. In all such devices, the same power means that impels the wedge into the log also advances the wedge through the log.

2. Related Art

U.S. Pat. No. 4,176,698 to Ahlschlager et al, issued Dec. 4, 1979 and entitled "Firewood Splitting Device", discloses a log-splitting device in which a wedge is driven into a log. The wedge is connected through a transfer link or pitman 20 that is pivotably attached to the wedge at one end and at the other end to a crank fixed to a flywheel. The crank is proportioned so that the stroke is relatively long and the drive is arranged so that oscillations are fairly slow (see column 2, lines 6–11).

The prior art also discloses hand-held splitting devices that are constructed without a stop member, or ram. For example, U.S. Pat. No. 5,107,911 to Plakotaris, issued Apr. 28, 1992 and entitled "Log Splitting Device", discloses a log splitting device generally consisting of a power jack hammer equipped with a log splitting head. U.S. Pat. No. 3,371,724 to Crowell, issued Mar. 5, 1968 and entitled "Power Wedge", discloses a power wedge for splitting logs, including a drive mechanism for the wedge that comprises a rotating cam against which a drive rod for the wedge is disposed.

SUMMARY OF THE INVENTION

The present invention provides a device for splitting logs, comprising a base having a wedge and a ram mounted thereon for receiving a log therebetween. At least one of the wedge and the ram are movable towards and away from the other. There is an impact means for driving the wedge into a first end of such log in a plurality of repeating strokes by striking at least one of the wedge and the ram. There is also an advancing means for urging the wedge and the ram towards each other.

In one aspect of the invention, the advancing means is controllable independently of the impact means.

According to other separate aspects of the invention, the impact means may be dimensioned and configured to generate more than two strokes per second. The strokes may have a duration of not more than 0.05 second each. The impact means may be dimensioned and configured to generate a stroke that is not greater than 5 percent of the maximum length between the ram and the wedge. Optionally, the stroke length may not be greater than 0.75 inch.

According to another aspect of the invention, the impact means may comprise a rotatable cam means for providing periodic strikes on one of the wedge and the ram upon rotation, the impact means further comprising driving means for rotating the cam means. In a particular embodiment, the driving means may comprise a shaft on which the cam means is mounted and a fly wheel mounted on the shaft for providing rotational inertia to the shaft and the cam means. In a particular embodiment, the cam means may comprise a pair of support plates secured to the shaft and a hammer member that is secured between the plates and that protrudes radially beyond the support plates.

The invention also broadly relates to a device for splitting a log having a first end and a second end, such device comprising a base, and a wedge and a ram mounted on the base for receiving a log therebetween, wherein at least one of said wedge and ram is slidably mounted on the base. Power means are provided for driving the wedge into such log in a plurality of strokes by striking at least one of the wedge and the ram with more than two blows per second, and for urging the wedge and ram towards each other.

According to one aspect of this device, the advancing means may engage one of the wedge and the ram, which would be slidably mounted on the base. in some instances, the impact means and the advancing means may engage the same one of the wedge and the ram, and the other of the wedge and ram may be fixedly mounted on the base. Alternatively, the impact means may engage one of said wedge and said ram and the advancing means may engage the other, in which case both the wedge and the ram may be slidably mounted on the base.

The present invention also relates to a method of splitting a log. The method comprises disposing the log between a ram and a wedge, and driving the wedge into the log in a series of strokes by imposing two or more blows per second on one of the wedge and the ram. Preferably, driving the wedge into the log comprises imposing blows that produce strokes having lengths of not greater than 5 percent of the maximum log length, or not greater than 0.75 inch. The method may comprise imposing blows that produce strokes having a duration of less than 0.05 second.

Preferably, advancing the wedge into the log is attained by a motion that is provided separately from the motion which provides the repeated blows of the wedge.

Other aspects of the present invention will be apparent from the following description and the appended drawings.

BRIEF DESCRIPTION OF THE DRAWINGS

The invention will be described herein with reference to the following Figures, in which like structures are given like identifying numerals.

DETAILED DESCRIPTION OF THE INVENTION AND PREFERRED EMBODIMENTS THEREOF

Figure 1A:
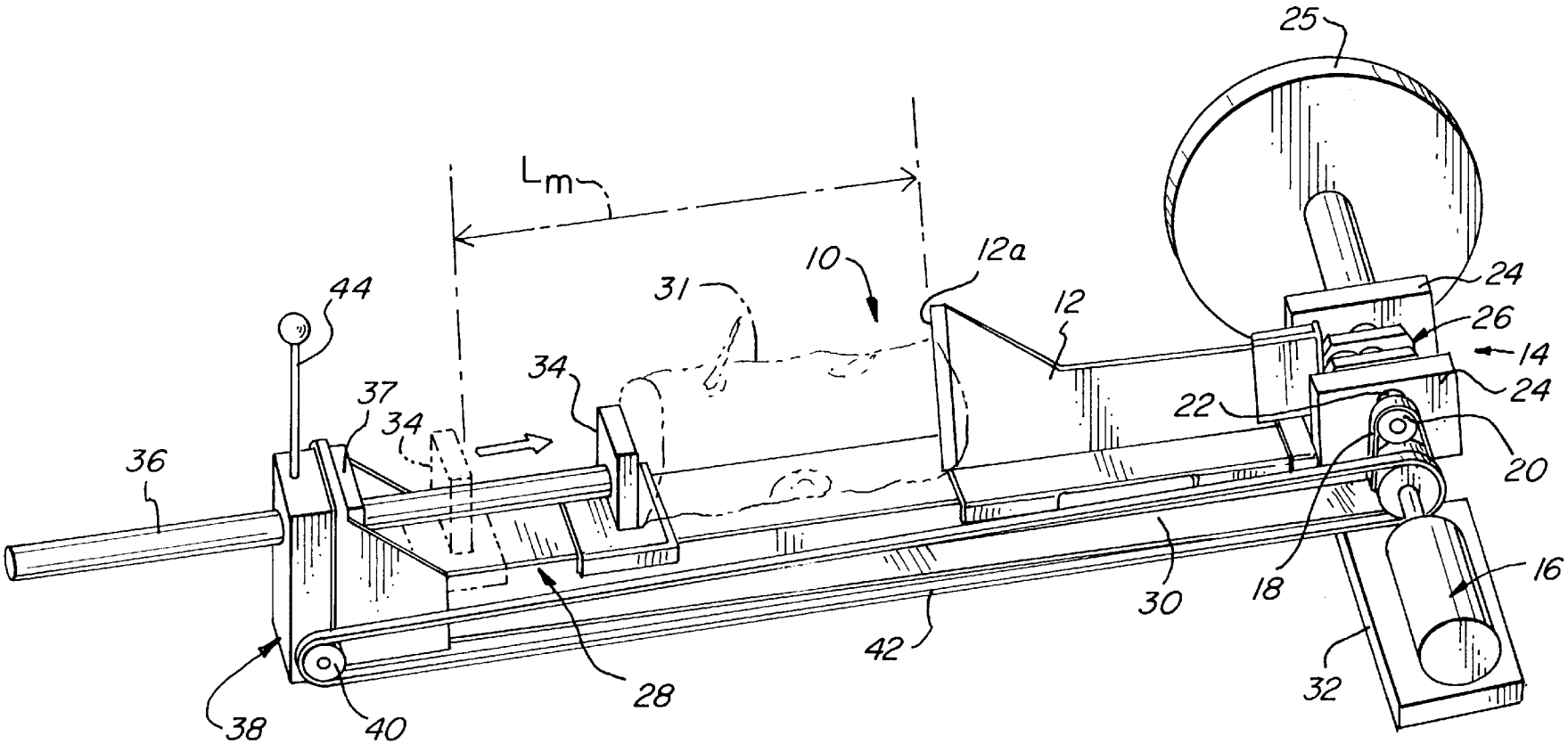
FIG. 1A is a perspective view of a log-splitting device in accordance with a particular embodiment of the present invention.

One feature of the present invention relates to a novel means and method for driving a wedge into a log. The invention may be embodied in a self-powered log-splitting device, i.e., a power log splitter. Rather than providing a slow, long stroke during which the log is disposed between the wedge and a ram, as is seen, e.g., in U.S. Pat. No. 4,176,698 (discussed above), the present invention provides, in one embodiment, a power log splitter having a wedge and a ram, and power means that drives the wedge into the log in a series of quick, short, repeated strokes or blows, and that urges the wedge and the ram together. The strokes may be generated by impact means and the ram and wedge may be urged together by advancing means as disclosed herein. As will be illustrated in the Figures and described more fully below, the ram and the wedge bear against respective opposite ends of the log. By imposing quick, short strokes on one of the wedge and the ram, the impact means drives the wedge into the log to the extent of the length of the stroke it imposes.

Another feature of the invention is that the device may comprise advancing means for advancing the wedge through the log independently of the strokes that drive the wedge into the log. Thus, the progress of the wedge through the log is not necessarily determined by the strokes that drive the wedge into the log. The advancing means assures that once the log is partially split by the action of the impact means, the wedge will advance further into the log to a position where the impact means can cause the wedge to further split the log. The advancing means functions to move the wedge and the ram closer together, so that the wedge becomes more deeply inserted into the log and so that the action of the impact means is imposed at increasing advanced points within the log.

Optionally, the log-splitting device of the present invention may be configured to define a maximum length for a log that it can split. Typically, this maximum length is determined by the distance between the ram and the cutting edge of the wedge when these two members are positioned fully apart from one another, and is designated the log length capacity, $L_m$. One or both, preferably both, of the wedge and the ram are slidably movable towards and away from each other along a common linear path, to enable spacing of the wedge and ram apart from each other for the log length capacity $L_m$, to receive a log lengthwise therebetween, and to come together to split the log between the wedge and the ram. The log is placed lengthwise to extend along the common linear path, with one end facing the wedge and the other end of the log facing the ram. Certain optional features of the present invention may be related to the log length capacity $L_m$. For example, the maximum length of the stroke by which the wedge is forced into one end of the log by the impact means may be less than 5 percent of the log length capacity $L_m$. Accordingly, in a device having a log length capacity of 15 inches, the stroke will preferably be 0.75 inch or smaller. Another optional feature is that the advancing means may enable the wedge to advance through the log at a rate such that the wedge can traverse the log length capacity $L_m$ within an interval that lasts between, e.g., 3 to 10 seconds. The strokes preferably have a frequency greater than 2 strokes per second (on average), e.g., 2.5 strokes per second, or more.

A log-splitting device in accordance with one embodiment of the present invention is shown in FIG. 1A. Device 10 comprises a wedge 12 that is positioned to receive strikes from, i.e., that engages, an impact means 14. Impact means 14 comprises a motor 16, an impact power belt 18 engaged with an impact pulley 20 mounted on main shaft 22. Main shaft 22 is rotatably mounted in spaced bearing blocks 24 and carries a flywheel 25. Also mounted on main shaft 22, between bearing blocks 24, is a cam assembly or cam means 26 for contacting wedge 12. Impact means 14 is fixedly mounted on a base 28 that comprises a steel I-beam 30 and a motor mount 32 attached thereto. Wedge 12 is slidably mounted on I-beam 30 so that a log 31 can be pushed against wedge 12 to make it bear against impact means 14, which can then drive the wedge 12 into the log.

The advancing means of device 10 comprises a pusher or ram 34 rotatably connected to the end of a threaded member such as a screw or worm shaft 36 that engages, i.e., is threaded into, another threaded member, e.g., a nut 37, that is fixedly mounted on base 28. A forward-neutral-reverse (F—N—R) transmission box 38 is mounted on I-beam 30 and drivably engages and rotates worm shaft 36 so that it advances or retreats, depending on whether the transmission box is set in F (forward) or R (reverse) gear, through nut 37. F—N—R transmission box 38 is equipped with a drive pulley 40 that is driven by motor 16 via drive belt 42. F—N—R transmission box 38 is controllable by the user through the manipulation of gear shift lever 44. Such transmission boxes are well-known in the art. Through the use of F—N—R transmission box 38, the user can advance or withdraw the wedge, i.e., close or open the distance between wedge 12 and ram 34, or allow wedge 12 to remain in place on base 28 even as the impact means operates. In the illustrated embodiment, the advancing means is driven off the same motor that drives the impact means; in alternative embodiments, the advancing means may have a drive mechanism that is separate from that of the impact means.

The log length capacity $L_m$ of device 10 is measured from the cutting edge 12*a* of wedge 12 to ram 34 when ram 34 is positioned as far from the cutting edge of wedge 12 as the configuration of device 10 will allow (shown in dotted outline in FIG. 1A).

Figure 1B:
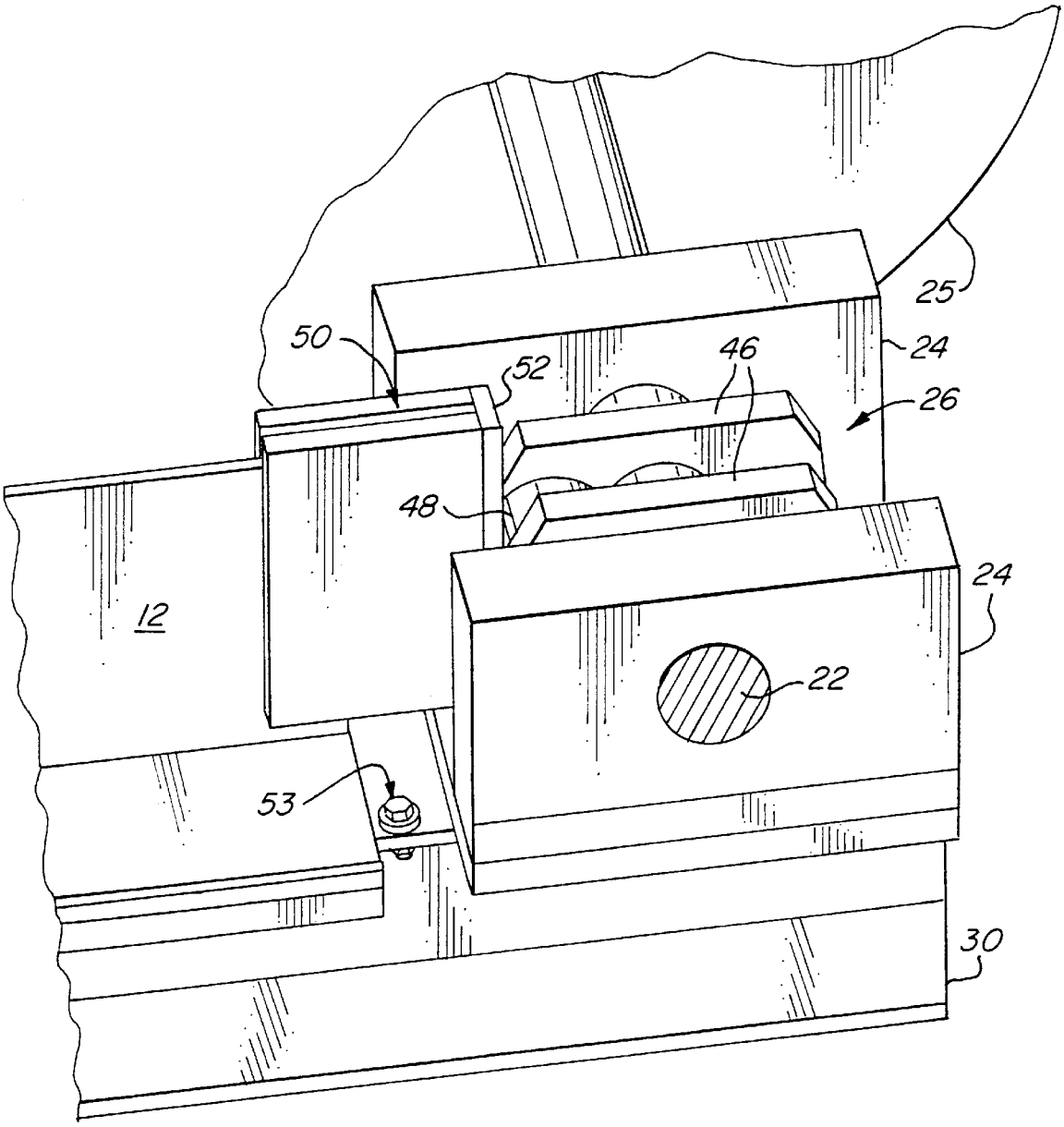
FIG. 1B is a perspective view of an enlarged portion of the device of FIG. 1A, enlarged to show the impact means of the device.

Some detail of the cam means 26 of FIG. 1A is better seen in FIG. 1B, in which portions of impact means 14 (FIG. 1A), including pulley 20 and belt 18, have been omitted for clarity. It is seen that cam means 26 comprises a pair of support plates 46 mounted on main shaft 22 and a rounded hammer member 48 rotatably mounted therebetween. FIG. 1B also shows that wedge 12 comprises a striking plate assembly 50 which provides a hardened striking plate 52 upon which rounded hammer member 48 may strike. Also seen is a stop lug 53 that is secured to base 28 and protrudes therefrom in a manner that limits the travel of wedge 12 towards cam means 26, as will be explained further below. Stop lug 53 may comprise a bolt extending through I-beam 30 to support and secure thereon a collet 53*a* (FIG. 1C) that can serve as a stop for wedge 12. Thus, when ram 34 (FIG. 1A) urges a log against cutting edge 12*a* of wedge 12, wedge 12 and striking plate 52 (FIG. 1B) thereof will be urged towards cam means 26 but it will not travel beyond stop lug 53.

Figure 1C:
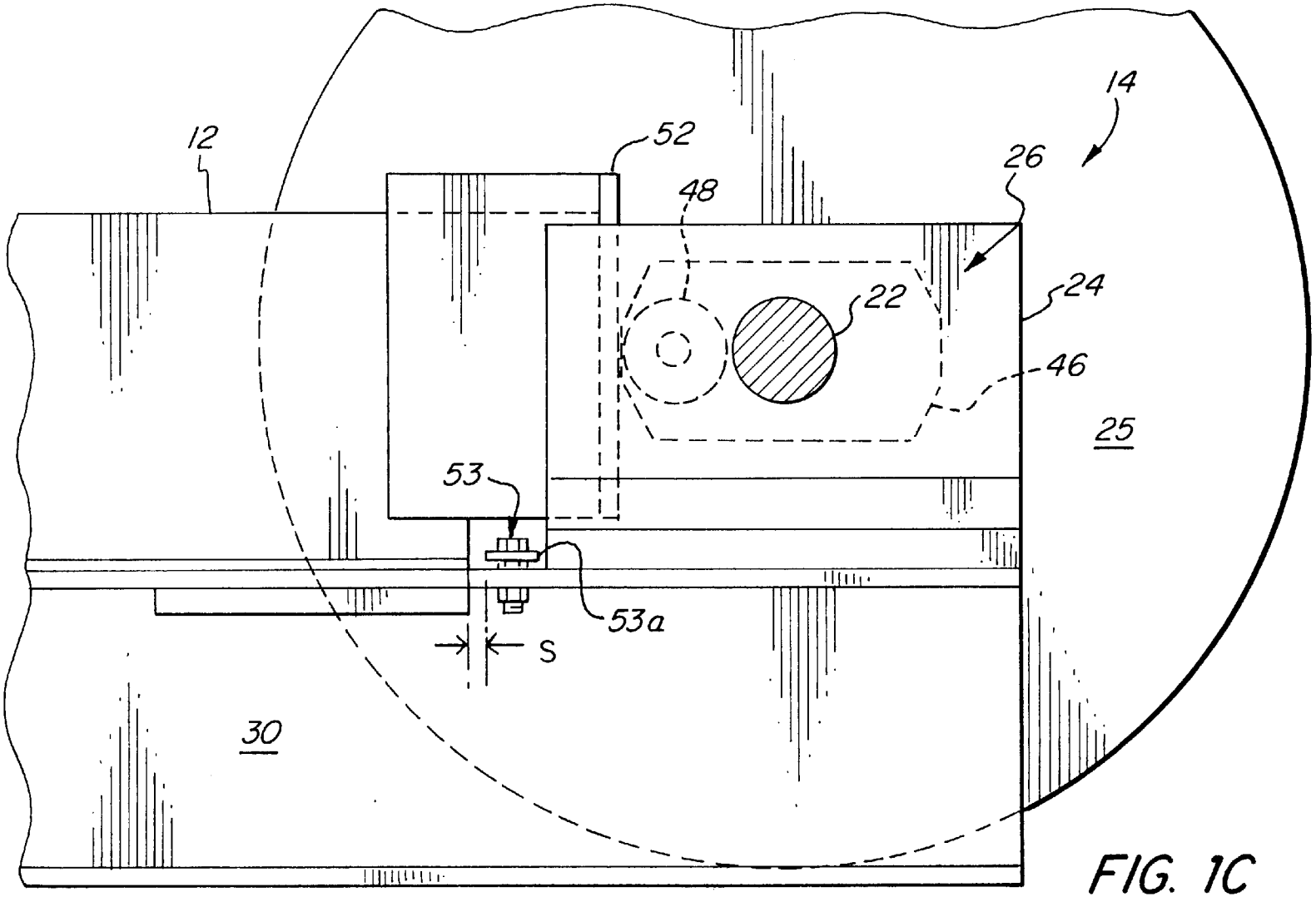
FIG. 1C is a schematic elevation view of the portion of the log-splitting device shown in FIG. 1B.

As seen in FIG. 1C, support plates 46 share a common profile about main shaft 22, and hammer member 48 protrudes beyond the largest radial measurement of the periphery of support plates 46, measured from the axis of rotation of main shaft 22. Stop lug 53 is positioned to prevent striking plate 52 from moving close enough to cam means 26 to bear on support plates 46 at any point during their rotation on main shaft 22. Harammer member 48, however, protrudes beyond the periphery of support plates 46 to a degree that allows it to strike striking plate 52 as shaft 22 rotates while wedge 12 is bearing against stop lug 53, at a point of greater radius than support plates 46. As shaft 22 continues to rotate, the point of contact of hammer member 48 and striking plate 52 will follow the curvature of the protruding portion of hammer member 48, thus pushing wedge 12 away from main shaft 22 until the contact point is at a maximum radial distance from main shaft 22 on the protruding periphery of hammer member 48, a position referred to herein as "top dead center". The resiliency of the log will probably push wedge 12 back against the cam means, so as main shaft 22 rotates past top dead center, member 48 at point remain in contact with hammer member 48 at points of decreasing distance from main shaft 22 until the movement of wedge 12 is stopped by stop lug 53.

In use, motor 16 (FIG. 1A) drives main shaft 22, which rotates cam means 26 and flywheel 25 and provides energy for transmission box 38 via drive belt 42. The user places a log 31 on the device with one end of the log facing ram 34 and the other end facing wedge 12. By manipulating lever 44, ram 34 is made to push log 31 against wedge 12. The force of the log on wedge 12 forces wedge 12 to slide into engagement with cam means 26, which delivers a series of blows on the striking plate 52 carried on wedge 12. Flywheel 25 lends rotational inertia to cam means 26 so that the force of log 31 on wedge 12 does not prevent cam means 26 from rotating. The blows delivered by cam means 26 make wedge 12 bite into the end of log 31 to the extent of the stroke created by cam means 26. (As will be discussed further below, wedge 12 can also be driven into log 31 by delivering blows on ram 34.) The user can then put transmission box 38 in "forward" to advance ram 34 towards wedge 12. By using the advancing means to urge together ram 34 and wedge 12, wedge 12 is advanced into log 31. The strokes imposed by impact means 14 will then further split the log. The user may then put transmission box 38 in "reverse" to return ram 34 to its original position, and then in "neutral" while another log is placed on the device, all while motor 16 continues to rotate cam means 26. By providing advancing means that operates independently from the impact means (e.g., by controlling the ram 34 through an F—N—R transmission box 38 that is driven by the same motor 16 that rotates the cam means 26), the present invention allows the user to insert new logs without having to stop the impact means. This permits continuous operation of a power source, e.g., motor 16, that is common to both the impact means and the advancing means despite interruptions in the splitting function. Accordingly, the use of this device is more orderly and convenient than prior art devices, and less wear is imposed on the impact means.

The frequency with which the impact means 14 of the present invention urges wedge 12 into a log will correspond to the rotational velocity of main shaft 22. As is clearly seen in FIG. 1C, support plates 46 have a bilateral symmetric configuration about main shaft 22. Accordingly, a second hammer member may optionally be mounted opposite hammer member 48. In such case, the frequency of the strokes imposed on wedge 12 by the impact means 14 would be twice that of the rotational speed of main shaft 22. The length of the stroke created by cam means 26 will be the maximum distance that hammer member 48 causes wedge 12 to move away from stop lug 53, indicated as distance "S" in FIG. 1C. Preferably, the stroke length S does not exceed 5 percent of the log length capacity $L_m$ of the device. Typically, stroke length S will not exceed about 0.75 inch (1.9 cm). The duration of the stroke will be the time interval from the initial contact of hammer member 48 with striking plate 52 until hammer member 48 has rotated to top dead center. The interval of contact with hammer member 48 after reaching top dead center is not considered part of the stroke interval. The duration of the stroke may correspond to a rotation of main shaft 22 through an angle of, e.g., about 45 degrees, and will, of course, be determined by the rate of rotation of main shaft 22. A typical stroke duration would be about 0.05 second.

Figure 1D:
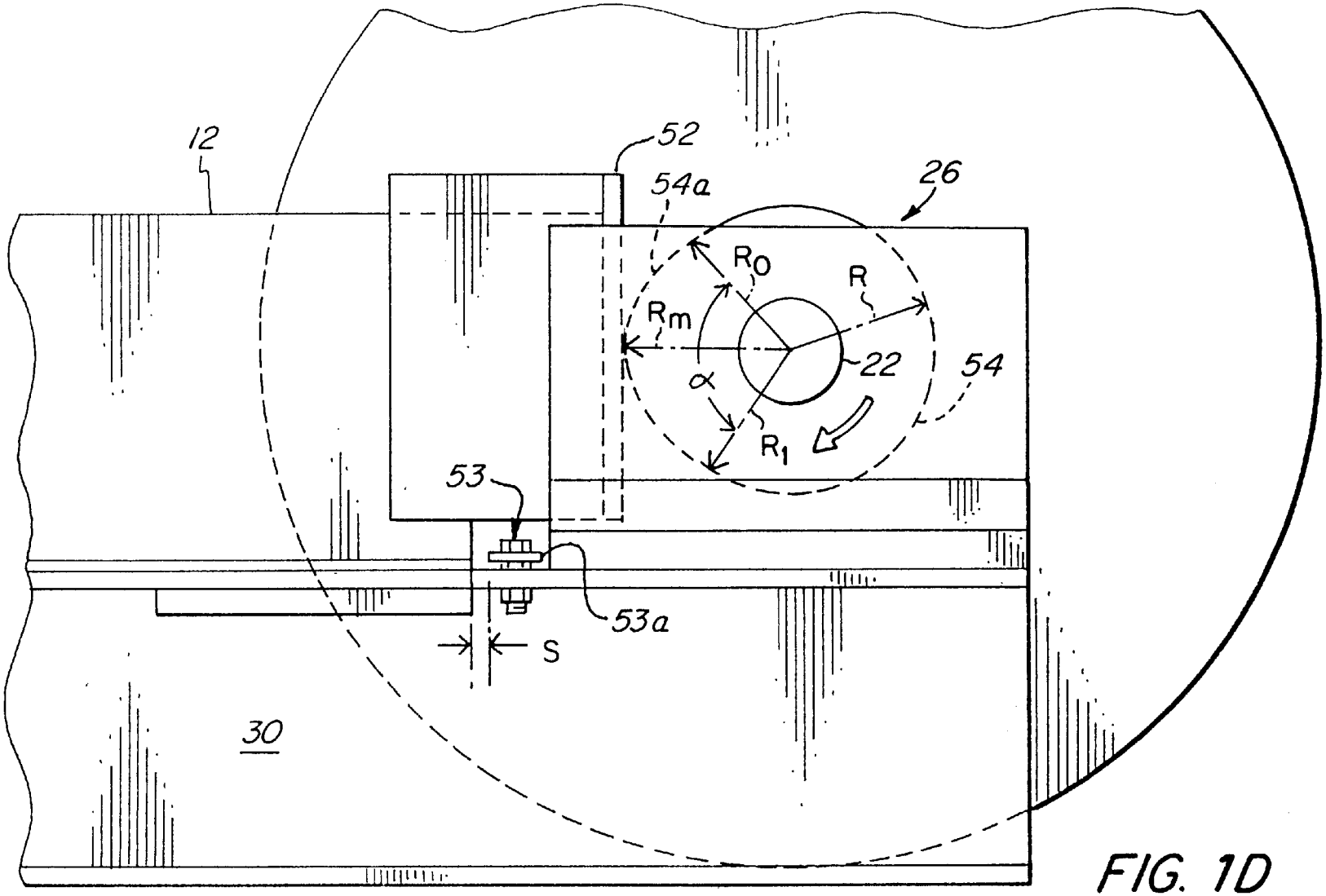
FIG. 1D is a view similar to FIG. 1C of yet another alternative embodiment of the invention.

In the embodiment of the invention shown in FIG. 1D, cam means 26 comprises a single eccentric cam 54 mounted on main shaft 22. Cam 54 has a mostly circular periphery, i.e., a constant radius R, about the center of main shaft 22. However, between point $R_0$ and $R_1$ there is a region of eccentricity 54*a* where the radius of cam 54 extends to a maximum at $R_m$ and then returns to radius R within radial angle $\alpha$. Stop lug 53 is positioned to prevent striking plate 52 from sliding into contact with the constant radius portion of cam 54, but it does allow contact between at least a portion of the region of eccentricity 54*a* and striking plate 52. Thus, the region of eccentricity 54*a* is equivalent to hammer member 48 (FIG. 1C).

Figure 2:
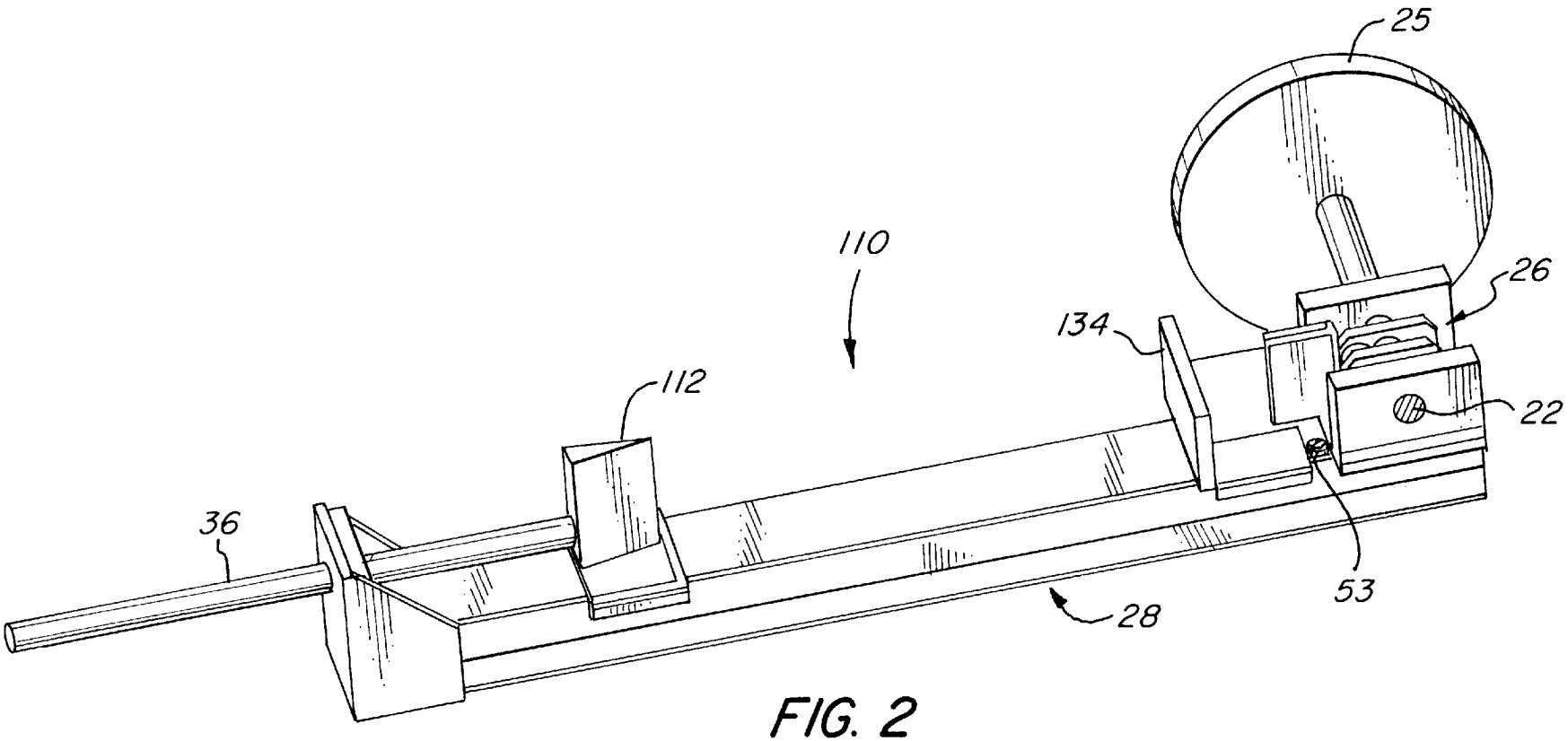
FIG. 2 is a perspective view similar to FIG. 1A of a log-splitting device according to still another embodiment of the invention, in which the transmission box 38 and other elements shown in FIG. 1A have been omitted, to simplify the drawing.

In the embodiment described in connection with device 10 of FIGS. 1A–1C, the impact means directly engaged the wedge while the advancing means engaged the ram. However, the relative positions of the wedge and ram of device 10 can be reversed so that the impact means directly engages the ram while the advancing means directly engages the wedge. Such an embodiment is illustrated in FIG. 2, in which portions of the impact means 14, shown in FIG. 1A, including pulley 20 and belt 18, are omitted for clarity, as is transmission box 38 and other elements that are unchanged in FIG. 2. In the operation of device 110 of FIG. 2, the advancing means is used to press wedge 112 against one end of a log while the other end rests against ram 134. Then, the operation of the impact means serves, in effect, to deliver a series of short, quick blows on the ram end of the log, thus driving the opposite end of the log into wedge 112. When wedge 112 has partially split or fractured that end of the log to the extent permitted by the length of the stroke operated by the impact means, the advancing means can be used to advance wedge 112 further into the log towards ram 134. Without the advancing means, the wedge in the illustrated embodiment would be unable to progress through the log beyond the extent of the strokes generated by the impact means. The length, frequency and duration of the blows delivered by ram 134 will be determined by the configuration of cam means 26, the location of stop lug 53 and the rotational velocity of shaft 22, just as with the embodiment of FIG. 1A. The blows delivered by ram 134 will have the same wedge-driving effect as blows delivered directly onto the wedge, as in device 10 of FIG. 1A.

As illustrated by FIG. 1A and FIG. 2, the impact means may directly engage either the wedge or the ram. The term "impact member" is sometimes used herein to refer to the structure directly engaged by the impact means, i.e., whichever of the ram and the wedge directly receives hammer-like blows from the impact means. Similarly, whichever of the ram and the wedge is moved by the advancing means may comprise part of the traveling component of the device. Thus, the impact means delivers blows directly onto the impact member (one of the wedge and the ram) to drive the wedge into one end of the log in a plurality of short strokes, and the advancing means moves the traveling component (comprising the other of the wedge and the ram) to assure that the wedge advances through the log as the strokes cause the log to split apart.

Figure 3:
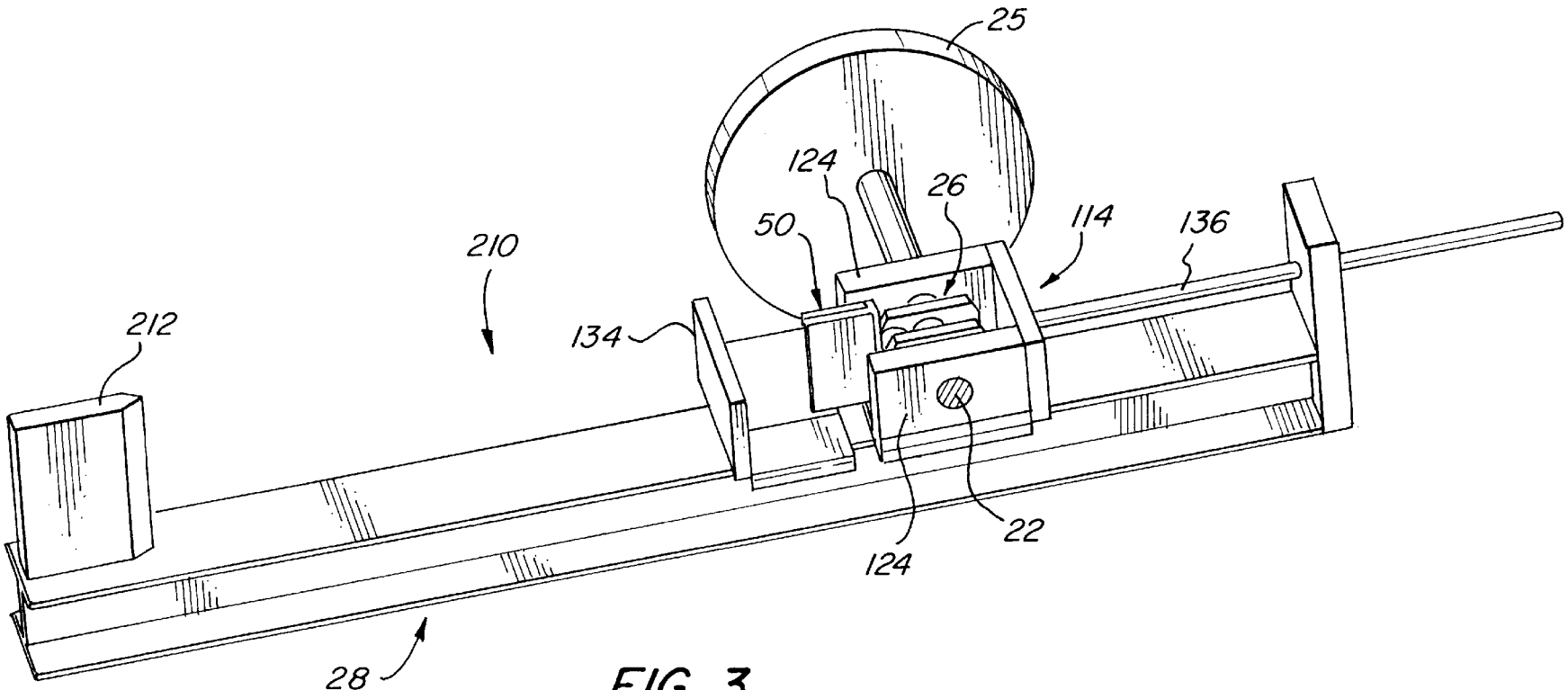
FIG. 3 is a view similar to FIG. 2 of another embodiment of the invention.
Figure 4:
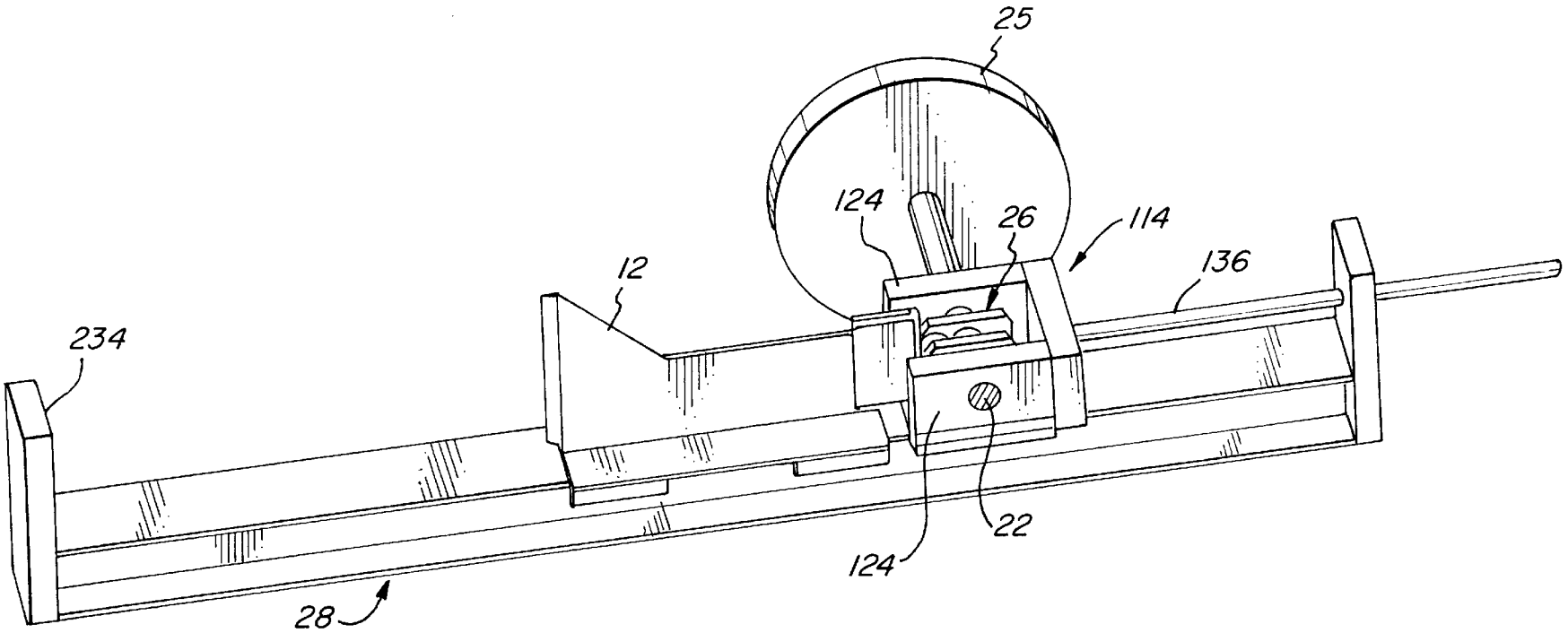
FIG. 4 is a view similar to FIG. 3 of still another embodiment of the invention.

In another broad embodiment of the invention, the impact means may be slidably disposed on the base and may comprise part of the traveling component of the device, so that the advancing means engages and moves the impact means and the associated impact member. In such an embodiment, whichever of the wedge and ram is the impact member will be subjected to a dual motion: the plurality of short strokes imposed by the impact means and the user-controlled, relatively slow, forward/reverse motion imposed by the advancing means. The other of the wedge and ram will typically be fixedly secured on the base of the device. In such cases, the motor portion of the impact means may comprise part of the traveling component of the device. Thus, FIG. 3 shows the pertinent portions of a device 210 that comprises a wedge 212 fixedly secured on base 28. The traveling component of device 210 includes an impact means 114 movably mounted on the base 28, including bearing blocks 124, a motor (not shown, but which may be mounted, e.g., on bearing blocks 124), a cam means 26, etc., and a ram 134 slidably mounted on base 28 and directly engaged by the impact means. Advancing means, represented by worm shaft 136, engages impact means 114 and thus, ram 134. Wedge 212 is fixedly mounted on, and is stationary relative to, base 28, but ram 134 is subjected to two kinds of motion, i.e., the short, quick strokes imposed by impact means 114 and the user-controlled motion imposed by the advancing means. In a similar embodiment shown in FIG. 4, the ram 234 is fixedly secured on base 28 while the advancing means, represented by worm shaft 136, engages the traveling component, including wedge 12 and impact means 114, and wedge 12 will be subjected to two different motions.

While the invention has been illustrated and described in connection with particular preferred embodiments thereof, numerous alterations to the illustrated embodiments will occur to one of ordinary skill in the art in view of the foregoing disclosure and it is intended to encompass such alterations within the scope of the appended claims.

What is claimed is:

1. A device for splitting logs, comprising:

a base;

a wedge and a ram mounted on the base for receiving a log therebetween, at least one of the wedge and the ram being movable towards and away from the other;

impact means for driving the wedge into a first end of such log in a plurality of repeating strokes by striking one of the wedge and the ram; and advancing means for urging the wedge and the ram towards each other.

2. The device of claim 1 wherein the advancing means is controllable independently of the impact means.

3. The device of claim 1 wherein the impact means is dimensioned and configured to generate more than two strokes per second.

4. The device of claim 3 wherein the impact means is dimensioned and configured to generate strokes that have a duration of not more than 0.05 second each.

5. The device of claim 2 or claim 3 wherein the impact means is dimensioned and configured to generate a stroke that is not greater than 5 percent of the maximum length between the wedge and the ram.

6. The device of claim 2 or claim 3 wherein the impact means is dimensioned and configured to generate a stroke that is not greater than 0.75 inch.

7. The device of claim 1, claim 2, claim 3 or claim 4 wherein the impact means comprises a rotatable cam means for providing periodic strikes on one of the wedge and the ram upon rotation, the impact means further comprising driving means for rotating the cam means.

8. The device of claim 7 wherein the driving means comprises a shaft on which the cam means is mounted and a fly wheel mounted on the shaft for providing rotational inertia to the shaft and the cam means.

9. The device of claim 8 wherein the cam means comprises a pair of support plates secured to the shaft and a hammer member that is secured between the support plates and that protrudes radially beyond the support plates.

10. A device for splitting a log having a first end and a second end, comprising:

a base;

a wedge and a ram mounted on the base for receiving a log therebetween, wherein at least one of the wedge and ram is slidably mounted on the base; and power means for driving the wedge into such log in a plurality of strokes by striking one of the wedge and the ran with more than two blows per second, and for urging the wedge and ram towards each other.

11. The device of claim 10 wherein the power means comprises impact means for generating the blows and advancing means that is user-controllable independently of the impact means and that engages one of the wedge and the ram.

12. The device of claim 11 wherein the impact means and the advancing means engage the same one of the wedge and the ram and wherein the other of the wedge and the ram is fixedly mounted on the base.

13. The device of claim 11 wherein the impact means engages one of the wedge and the ram and the advancing means engages the other, wherein both the wedge and the ram are slidably mounted on the base.

14. A method of splitting a log, comprising:

disposing the log between a ram and a wedge; and driving the wedge into the log in a series of strokes by imposing two or more blows per second on one of the wedge and the ram.

15. The method of claim 14 comprising imposing blows that produce strokes having lengths of not greater than 5 percent of the maximum length between the wedge and the ram.

16. The method of claim 14 or claim 15 wherein each stroke has a duration of less than 0.05 second.

17. The method of claim 14 further comprising advancing the wedge into the log in a motion that is separable from the blows.

18. The method of claim 14, claim 15 or claim 16 comprising imposing blows that produce strokes having lengths of not greater than 0.75 inch.

* * * * *

UNITED STATES PATENT AND TRADEMARK OFFICE

CERTIFICATE OF CORRECTION

PATENT NO. : 5,921,300
DATED : July 13, 1999
INVENTOR(S) : Kelvin M. Smith

It is certified that error appears in the above-identified patent and that said Letters Patent is hereby corrected as shown below:

Column 5,
Line 8, replace "Harammer" with -- Hammer --;
Lines 21-22, replace "member 48 at point remain in contact" with -- striking plate 52 will remain in contact --.

Signed and Sealed this

Second Day of July, 2002

*Attest:*

*Attesting Officer*

JAMES E. ROGAN
*Director of the United States Patent and Trademark Office*